US009039466B2

(12) United States Patent
Iio

(10) Patent No.: US 9,039,466 B2
(45) Date of Patent: May 26, 2015

(54) CRIMP TERMINAL HAVING ENGAGING PORTIONS EXTENDING FORWARD FROM CORE CRIMPING PORTIONS

(71) Applicant: Sumitomo Wiring Systems, Ltd., Yokkaichi, Mie (JP)

(72) Inventor: Kiyokazu Iio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/803,283

(22) Filed: Mar. 14, 2013

(65) Prior Publication Data

US 2013/0330986 A1 Dec. 12, 2013

(30) Foreign Application Priority Data

Jun. 7, 2012 (JP) ..... 2012-129890

(51) Int. Cl.

| | |
|---|---|
| ***H01R 4/10*** | (2006.01) |
| ***H01R 4/18*** | (2006.01) |
| *H01R 4/72* | (2006.01) |
| *H01R 11/12* | (2006.01) |
| *H01R 13/213* | (2006.01) |

(52) U.S. Cl.

CPC ..... *H01R 4/182* (2013.01); *H01R 4/188* (2013.01); *H01R 4/72* (2013.01); *H01R 11/12* (2013.01); *H01R 13/213* (2013.01)

(58) Field of Classification Search

CPC ..... H01R 4/182
USPC ..... 439/877–891
See application file for complete search history.

(56) References Cited

U.S. PATENT DOCUMENTS

| | | | | |
|---|---|---|---|---|
| 3,120,990 | A * | 2/1964 | Kinkald | 439/855 |
| 3,805,221 | A * | 4/1974 | Kuo | 439/877 |
| 6,290,556 | B1 * | 9/2001 | Howland et al. | 439/879 |
| 7,255,611 | B2 * | 8/2007 | Kubo et al. | 439/748 |
| 7,314,386 | B2 * | 1/2008 | Kao | 439/607.27 |
| 2011/0094797 | A1 * | 4/2011 | Otsuka et al. | 174/84 |
| 2011/0136397 | A1 * | 6/2011 | Koga et al. | 439/877 |

FOREIGN PATENT DOCUMENTS

| | | |
|---|---|---|
| JP | 5-8871 | 2/1993 |
| JP | 5-31130 | 4/1993 |
| JP | 5-31131 | 4/1993 |
| JP | 10-289745 | 10/1998 |
| JP | 2000-182688 | 6/2000 |
| JP | 2008-176970 | 7/2008 |
| JP | 2009-230998 | 10/2009 |

* cited by examiner

*Primary Examiner* — Chandrika Prasad
(74) *Attorney, Agent, or Firm* — Gerald E. Hespos; Michael J. Porco; Matthew T. Hespos

(57) ABSTRACT

A crimp terminal (10) has a connecting portion (12) that is conductively connected to an electrical connection target, a crimp portion (14) that is fixed by crimping to a core (58) of a coated wire (56), and a link (16) extending between the connecting portion (12) and the crimp portion (14). The crimp portion (14) has a placement portion (36) on which the core (58) of the coated wire (56) is placed, and a core crimping portion (38) protruding from opposite edges of the placement portion (36). Extended portions (48) are provided on ends of the core crimping portions (38) toward the link (16) and at least one engaging corner (52) is formed on an upper end surface (50) of each of the extended portions (48).

12 Claims, 4 Drawing Sheets

CRIMP TERMINAL HAVING ENGAGING PORTIONS EXTENDING FORWARD FROM CORE CRIMPING PORTIONS

BACKGROUND OF THE INVENTION

1. Field of the Invention

The invention relates to a crimp terminal that is attached by crimping to an exposed core at the end of a coated wire.

2. Description of the Related Art

Crimp terminals have been employed widely with coated wires in the electrical systems of cars and the like and are attached by being crimped to an exposed core at the terminal of the coated wire. JP 5-31130A discloses one such crimp terminal that has a connecting portion, a crimp portion and a link extending therebetween. The connection portion has a conductive member, such as a metal, that is connected conductively to an electrical connection target. The crimp portion has a core crimping portion that is fixed by crimping to an outer peripheral surface of the core of the coated wire. The section of the crimp terminal attached to the coated wire often should be waterproof. Thus, a covering cylindrical body may be mounted over a peripheral region that includes the crimp portion. The covering cylindrical body may be a heat shrinkable tube containing hot-melt adhesive. The tube may be mounted over a peripheral region that includes the crimp portion. Heat then is applied to shrink the tube and to melt the adhesive. Alternatively, a peripheral region of the crimp portion may be sealed by a cylindrical molded component made of a synthetic resin.

The core must contact the crimp portion over a sufficient area to ensure reliable conduction between the crimp terminal and the core. Also, the covering cylindrical body must reliably cover the crimp portion and the core to ensure waterproofness of the crimp portion. Accordingly, JP 5-31130A proposes forming a large notch in a central section of the link between the connecting portion and the crimp portion, and an upstanding protuberance is formed by bending up the notched section on the side on which the crimp portion protrudes. The core is inserted into the crimp portion until the core abuts the upstanding protuberance, thereby ensuring sufficient contact points between the crimp portion and the core of the coated wire. Also, the covering cylindrical body is moved to a position beyond the upstanding protuberance so that the crimp portion and the core can be covered reliably with the covering cylindrical body. The engagement of the upstanding protuberance and the covering cylindrical body prevents the covering cylindrical body from coming loose and sliding back to expose the core to the outside due to vibrations, heat during vehicle installation, and the like.

An external force caused by vibrations or interference with other members will concentrate on the link between the connecting portion, which is the fixing point to the connection target, and the crimp portion, which is the fixing point to the coated wire. These external forces may apply a large bending force to the link. However, a large notch is provided in the link to form the upstanding protuberance. As a result, the connecting portion and the crimp portion are connected merely by edges of the link. Hence, the link may not have sufficient rigidity, thereby leading to problems, such as durability deterioration and breakage of the link.

The invention was made in view of the preceding circumstances, and an object of thereof is to ease positioning a core and a covering cylindrical body on a crimp terminal, to prevent a position shift of the covering cylindrical body and to ensure rigidity of a link and to improve mounting flexibility on a terminal bolt.

SUMMARY OF THE INVENTION

The invention relates to a crimp terminal with a connecting portion that is connected conductively to an electrical connection target, a crimp portion that has a core crimping portion that is fixed by crimping to a core of a coated wire, and a link extending between the connecting portion and the crimp portion. The crimp portion includes a placement portion on which the core of the coated wire is placed and a core crimping portion bent to protrude in a plate-like manner from both sides in a width direction of the placement portion and rising on a side on which the core is placed. Extended portion are provided on base ends of the core crimping portions at an end from which the link extends, and engaging corners are formed on upper end surfaces of the extended portions.

The extended portion provided on the base of the core crimping portions is bent up relative to the placement portion when the core crimping portions are bent up to the core placement side of the placement portion. Accordingly, the engaging corners formed on the upper end surface of the extended portions define steps that rises up in an axially perpendicular direction orthogonal to an axial direction of a covering cylindrical body such as a heat shrinkable tube that is placed over the core crimping portion and the link. A ridge-like engaging section for engaging an inner surface of the covering cylindrical body can be added easily to the core crimping portions without an accompanying increase in the number of components and can prevent a position shift of the covering cylindrical body from the core crimping portion.

The engaging corner on an upper end surface of the extended portion at the base of the core crimping portions can engage the inner surface of the covering cylindrical body. Thus, the inner surface of the covering cylindrical body can be engaged without providing a large notch in the link of the crimp terminal, as with the conventional structure. Accordingly, a section for engaging the covering cylindrical body is provided, while ensuring sufficient rigidity of the link on which stress is concentrated during use.

The section of the crimp terminal for engaging the covering cylindrical body is defined by an engaging corner on the upper end surface of the extended portion of the core crimping portions. Thus, the section for engaging the covering cylindrical body is provided in the crimp portion and is sufficiently separated from the connecting portion, compared with the case where the engaging section is provides in the link, such as with the conventional structure. Hence, a plurality of crimp terminals can be stacked on a single terminal bolt without interference of the engaging sections in the stacking direction of the crimp terminals, thereby improving mounting flexibility on a single terminal bolt.

The engaging corners may be defined, for example, by configuring the extended portions to be approximately rectangular and utilizing an upper corner of the extended portions, or cutting away an upper end surface of the extended portions in a stepped manner and utilizing the stepped surface.

Only one engaging corner need be provided on an upper end surface of the extended portion in each core crimping portion. However, a plurality of engaging corner portions may be provided.

The upper end surface of the extended portions may be cut in a stepped manner to form a plurality of the engaging corners on the upper end surface of the extended portions of the crimp terminal. The plurality of engaging corner portions engaging the inner surface of the covering cylindrical body more reliably prevent a position shift of the covering cylindrical body to the core crimping portion side.

A reinforcing ridge may be provided in a laterally central section of the link and may extend in a longitudinal direction of the link. The reinforcing ridge further reinforces the link. Also, the core can be positioned with an end portion of the longitudinally extending reinforcing ridge on the crimp portion side as a marker. Thus, the core can be covered stably with the covering cylindrical body, and the task of positioning these components can be performed easily. The reinforcing ridge may include both a portion forming a ridge on the upper surface of the link (side on which the core crimping portions protrude) and a portion forming a ridge on the lower surface.

The crimp terminal has an extended portion on the base of the core crimping portions and at an end toward the link. Engaging corners are formed on upper ends of the extended portions and engage an inner surface of the covering cylindrical body to prevent position shifts. A large notch is not required in the link. Thus, a section for engaging the covering cylindrical body can be provided while ensuring sufficient rigidity of the link.

DETAILED DESCRIPTION OF THE PREFERRED EMBODIMENTS

Figure 1:
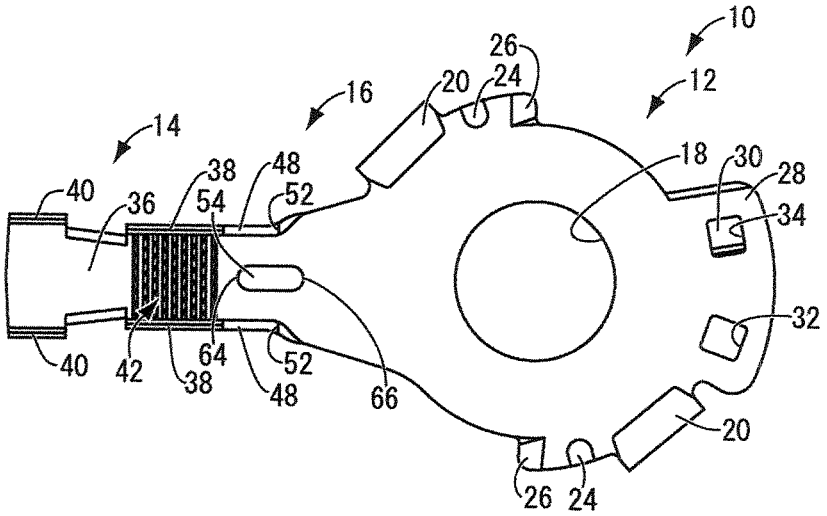
FIG. 1 is a plan view of a crimp terminal serving as a first embodiment of the present invention.

A crimp terminal in accordance with the invention is identified by the numeral 10 in FIGS. 1 to 5. The crimp terminal 10 is formed unitarily to include a connecting portion 12 that is to be connected electrically conductively to a connection target, a crimp portion 14 having core crimping portions 38 that are to be fixed by crimping to a core 58 of a coated wire 56, and a link 16 extending therebetween.

The crimp terminal 10 is formed from a conductive metal, such as brass, copper, copper alloy, aluminum and aluminum alloy, that is capable of undergoing processing, such as pressing and punching. The crimp terminal 10 is of approximately uniform thickness throughout.

Figure 3:
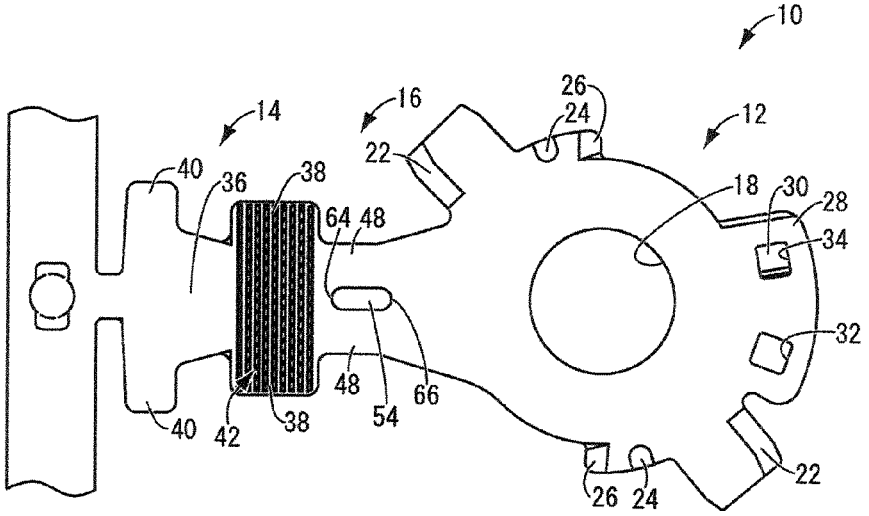
FIG. 3 is an opened-up view of the crimp terminal shown in FIG. 1.

The connecting portion 12 has an approximately elliptical planar shape, and a through hole 18 passes through a central section. The through hole 18 can receive a terminal bolt that is screwed into a predetermined position. Two diametrically opposed accommodating portions 20 are provided on the outer periphery of the connecting portion 12. The accommodating portions 20 are formed from approximately rectangular planar protrusions that are bent up from the plane of the connecting portion 12 to define U-shapes with accommodating grooves 22 that open in toward the center of the connecting portion 12. As shown in FIG. 3, one edge of each accommodating portion 20 is thinned to define a tapered entry to each accommodating groove 22. Protuberances 24 are provided in positions slightly separated clockwise from the respective accommodating portions 20, and tapered portions 26 are in positions slightly separated further clockwise therefrom. The tapered portions 26 have shapes corresponding to the accommodating grooves 22. A lengthened portion 28 extends out from the outer periphery of the connecting portion 12 at a position diametrically opposite the crimp portion 14 (right side in FIG. 1). An upstanding protuberance 30 and a rectangular through hole 32 are formed in the lengthened portion 28 at positions separated in the circumferential direction. The protuberance 30 is formed by making a U-shaped cut in the lengthened portion 28 and bending up a region enclosed the U-shaped cut to form a notch 34 below the protuberance 30. The protuberance 30 is offset by a dimension that is approximately the same as or less than the plate thickness of the lengthened portion 28. The protuberance 30 is slightly smaller than the through hole 32 and thus can fit in the through hole 32 of another crimp terminal 10.

The crimp portion 14 has a placement portion 36 with a long approximately rectangular planar shape. Core crimping portions 38 and coated wire crimping portions 40 are provided on opposite widthwise sides of the placement portion 36. The core crimping portions 38 and coated wire crimping portions 40 initially are approximately rectangular planar pieces that protrude from opposite sides of the placement portion 36 and then are bent up to define walls on both sides of the placement portion 36. Protuberances 42 that may be trapezoidal extend across the entire surface of the core crimping portions 38 and the region therebetween.

An extended portion 48 is provided on a base 44 of each core crimping portion 38 and at an end of the respective core crimping portion 38 toward the link 16. Additionally, an engaging corner 52 is formed at an upper end surface 50 of each extended portion 48. Furthermore, the extended portions 48 are provided in the same position in a longitudinal direction of the crimp portion 14. The extended portions 48 can be formed simply by changing the pressing and punching pattern and are at locations that would otherwise have be scrap, as is clear from FIG. 3. Also, the extended portions 48 are bent to rise up from the placement portion 36 simultaneously when bending the core crimping portions 38. Thus, the extended portions 48 can be provided without an accompanying increase in the number of components or materials, or an increase in working processes.

A reinforcing ridge 46 is provided in a widthwise central section of the link 16 and projects both up on the upper surface (up in FIG. 2) of the link 16 and down from the lower surface to achieve further reinforcement of the link 16.

Figure 4:
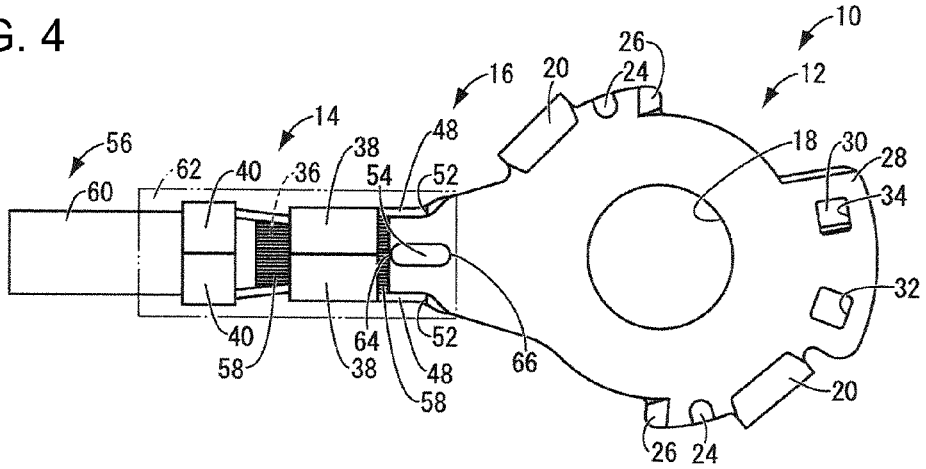
FIG. 4 is a plan view of an electrical wire with attached heat shrinkable tube to which the crimp terminal shown in FIG. 1 is attached.

The method of crimping the coated wire 56 to the crimp terminal 10 of the present embodiment will be described with reference to FIG. 4. The core 58 of the coated wire 56 is formed by bundling copper, aluminum or other metal wires to define a conductor that is covered with an insulation sheath 60 made of ethylene resin, styrene resin or other material having electrical insulation properties. First, the insulation sheath 60 on the end of the coated wire 56 is stripped to expose the core 58. Next, a heat shrinkable tube 62 is mounted on the outer peripheral side of this coated wire 56.

The end of the coated wire 56 at which the core 58 is exposed is placed on the upper surface of the placement portion 36 in the crimp portion 14 of the crimp terminal 10. At this point, the core 58 is positioned so that the end of the core 58 is over the reinforcing ridge 46, and is, for example, positioned to reach an end portion 64 on the crimp portion side. It is thereby possible to simply and accurately arrange the core 58 exposed between the core crimping portions 38, and arrange a section covered with the insulation sheath 60 between the coated wire crimping portions 40.

Crimping then is performed on the core crimping portions 38 and the coated wire crimping portions 40 using a well-known crimping device, such as shown in JP 05-23389A. The core crimping portions 38 and the coated wire crimping portions 40 thereby plastically deform and wrap around the outer peripheral surface of the core 58 and the coated wire 56. The inner surface of the crimp portion 14 will abut against the outermost peripheral surface of the core 58 and the coated wire 56 in a crimped state, and the protuberances 42 on the inner surface of the core crimping portions 38 provide a large contact area with the core 58. Note that, in this state, the core 52 remains exposed.

Next, the heat shrinkable tube 62 is slid along the coated wire 56 until the end of the heat shrinkable tube 62 is beyond an end 66 on the connecting portion side of the reinforcing ridge 54. The end portion 66 on the connecting portion side of the reinforcing ridge 54 is more on the connecting portion 12 side than are the engaging corners 52 of the extended portions 48. Thus, the engaging corners 52 can engage the inner surface of the heat shrinkable tube 62 with sufficient coverage. Hence, the heat shrinkable tube 62 will not come loose due to heat generated in the usage environment to expose the core 58 of the coated wire 56 or the crimp portion 14. In this state, the heat shrinkable tube 62 is heated using heating means such as an electric heater.

The heat shrinkable tube 62 is thereby heat shrunk and a hot-melt adhesive (not shown) melted during the heating adheres a section of the core 58 from the engaging corners 52, the core crimping portions 38 and coated wire crimping portions 40, and an end of the insulation sheath 60 due to the shrink force of the heat shrinkable tube 62. Moreover, the hot-melt adhesive melted by the heating loses viscosity and fluidizes so that the space between the abovementioned members is filled completely without leaving large gaps and in a liquid-tight state.

Figure 5:
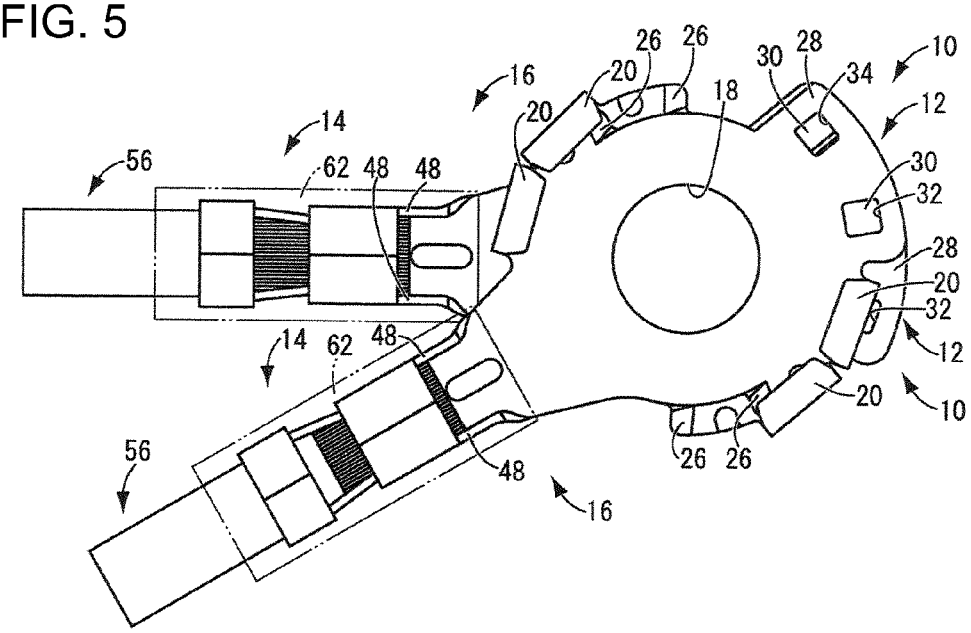
FIG. 5 is a plan view showing a state where the crimp terminals of electrical wires with attached heat shrinkable tubes to which the crimp terminals shown in FIG. 4 are attached are stacked.

A plurality of the crimp terminals 10 may be stacked on a single terminal bolt by placing the crimp terminals 10 one on top of the other so that the through holes 18 thereof coincide, as shown in FIG. 5. More particularly, one crimp terminal 10 is placed on another crimp terminal 10 so that the through holes 18 coincide and so that the tapered portions 26 of the upper crimp terminal 10 are substantially adjacent and counterclockwise of the accommodating grooves 22 in the accommodating portions 20 of the lower (bottom side in FIG. 5) crimp terminal 10. The upper crimp terminal 10 then is rotated clockwise so that the tapered portions 26 of the upper crimp terminal 10 enter the accommodating grooves 22 in the accommodating portions 20 of the lower crimp terminal 10. The upstanding protuberances 30 of the lower crimp terminal 10 are pressed down resiliently upon entering the accommodating grooves 22, but return resiliently to enter and engage the through holes 32 of the upper crimp terminal 10 after sufficient rotation. The accommodating portions 20 and the upstanding protuberances 30 of the lower crimp terminal 10 position and retain the outer periphery of the upper crimp terminal 10, before the crimp terminals 10 are screwed down by the terminal bolt. Additional crimp terminals 10 can be placed thereon in a similar manner. The section in the crimp terminal 10 of the for engaging the heat shrinkable tube 62 is constituted by the engaging corners 52 on the upper end surfaces 50 of the extended portions 48 of the core crimping portions 38. Thus, the engaging section can be provided in a position that is sufficiently separated from the connecting portion 12, compared with the case where the engaging section is provided in the link 16, such as with the conventional structure. Hence, even when a plurality of crimp terminals 10 are mounted by stacking on a single terminal bolt, interference of the engaging sections in the stacking direction of the crimp terminals 10 can be avoided.

Figure 2:
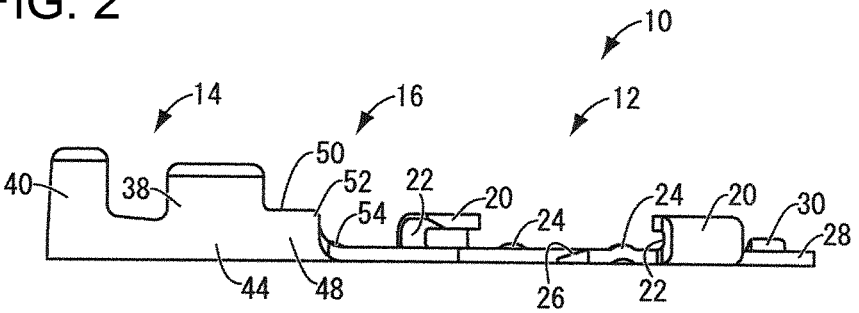
FIG. 2 is a side view of the crimp terminal shown in FIG. 1.

According to the above-described embodiment, the extended portions 48 are provided on the bases 44 of the core crimping portions 38 and at the ends of the core crimping portions toward the link 16. Additionally, the engaging corners 52 are formed on the upper end surfaces 50 of the extended portions 48. The side edge portions on the link 16 side of the extended portions 48 thus define stepped surfaces that rise up in an axially perpendicular direction orthogonal to the axial direction of a covering cylindrical body, such as the heat shrinkable tube 62, that is mounted over the core crimping portions 38. Accordingly, the engaging corners 52 easily can be added to the core crimping portions 38 as ridge-like engaging sections for engaging the inner surface of the covering cylindrical body, without an accompanying increase in the number of components. The engaging corners 52 advantageously prevent a position shift of the covering cylindrical body from the core crimping portions 38. Note that although the shape of the engaging corners 52 is not particularly limited, the engaging corners 52 desirably have round-corners rounded corners, as shown in FIG. 2 to prevent tearing or the like of the covering cylindrical body.

The link 16 has no large notch, as with the conventional structure. Thus, the engaging corners 52 can engage the inner surface of the covering cylindrical body while ensuring sufficient rigidity of the link 16 on which stress is concentrated during use.

The reinforcing ridge 54 also reinforces the link 16 and extends in the longitudinal direction of the link 16. Thus, the core 58 can be covered stably with the covering cylindrical body, and the task of positioning these components can be performed easily by positioning the core 58 so that the end of the core 58 reaches the end 64 on the crimp portion side of the reinforcing ridge 54, and by positioning the heat shrinkable tube 62 so that the end of the heat shrinkable tube 62 is beyond the end portion 66 on the connecting portion side of the reinforcing ridge 54.

Additionally, the section for engaging the covering cylindrical body includes the engaging corners 52 of the extended portions 48 of the core crimping portions 38 provided in the crimp portion 14. Thus, the section for engaging the covering cylindrical body can be provided in the crimp portion 14 which is sufficiently separated from the connecting portion 12, compared to the conventional structure where the engaging section is provided in the link 16. Hence, even in the case of mounting a plurality of crimp terminals 10 by stacking on a single terminal bolt, interference of the engaging sections in the stacking direction of the crimp terminals 10 can be advantageously avoided.

Figure 6:
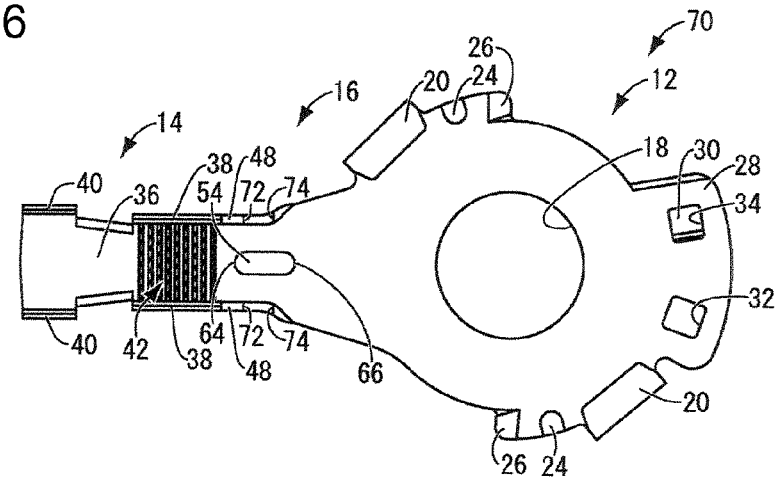
FIG. 6 is a plan view of a crimp terminal serving as a second embodiment of the present invention.
Figure 7:
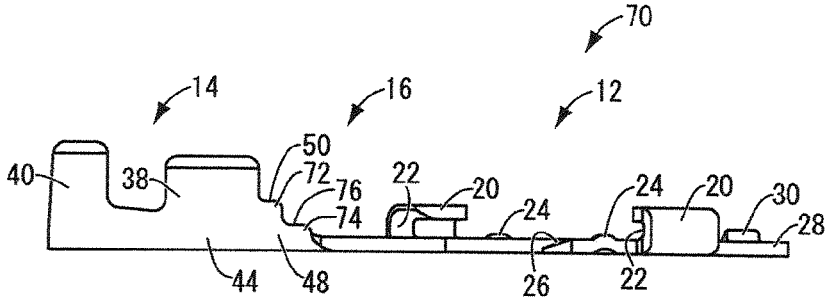
FIG. 7 is a side view of the crimp terminal shown in FIG. 6.
Figure 8:
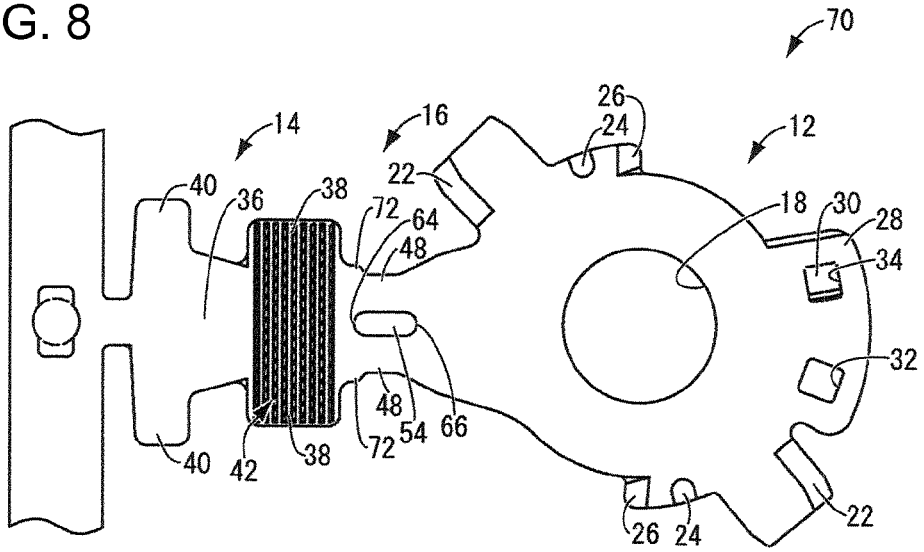
FIG. 8 is an opened-up view of the crimp terminal shown in FIG. 6.

A crimp terminal in accordance with a second embodiment is identified by the numeral 70 in FIGS. 6 to 8. Elements of the second embodiment that are the same as or similar to the first embodiment are identified by the same reference numbers as the first embodiment and are not described again.

The crimp terminal 70 differs from the first embodiment by having a plurality of engaging corner portions 72 and 74 formed on upper end surfaces 50 and 76 of the extended portions 48 in a stepped manner. More specifically, two engaging corners 72 and 74 are provided on the upper end surfaces 50 and 76 of the extended portions 48. The two engaging corners 72 and 74 engage the inner surface of the covering cylindrical body to prevent a position shift of the covering cylindrical body more reliably.

Although embodiments of the present invention have been described above, the present invention is not limited in any way by the specific description in the embodiments. For example, although in the present embodiments the extended portions 48 have an approximately rectangular planar shape, and the engaging corners 52, 72 and 74 are defined by corners of the extended portions 48 or corners formed when these corners are cut away in a stepped manner. However, a configuration may be adopted in which protuberances of arbitrary shape protrude unitarily up from the upper end surfaces 50 of the extended portions 48, and engaging corners are constituted by the protuberances. In this case, the shape of the protuberances can be set arbitrarily to be rectangular, circular, polygonal, or the like. One or two sections for engaging the covering cylindrical body, such as the engaging corners 52 and the engaging corners 72 and 74, was described above. However, there may be three or more engaging sections. Additionally, the engaging corners may protrude on a side edge of the extended portions 48.

A cylindrical molded component made of a synthetic resin may enclose the crimp portion 14 from the outside instead of using the heat shrinkable tube 62 as the covering cylindrical body. Effects similar to the case of the heat shrinkable tube 62, such as prevention of position shift, improvement in the degree of mounting flexibility and ease of positioning, that are realized by the crimp terminal 10 of the invention can be enjoyed even with a cylindrical molded component.

What is claimed is:

1. A crimp terminal having opposite front and rear ends, the crimp terminal comprising:

a connecting portion in proximity to the front end and being configured to be connected conductively to an electrical connection target;

a crimp portion rearward of the connecting portion and having a placement portion for receiving a core of a coated wire, core crimping portions protruding from opposite sides of the placement portion and having upper edges remote from the placement portion, the core crimping portions being configured to be crimped into engagement with the core placed on the placement portion;

a link extending between the connecting portion and the crimp portion; and extended portions extending forward from the core crimping portions, each of the extended portions having an upper edge extending forward from the respective core crimping portions at a height lower than the upper edge of the respective core crimping portion and a front edge extending up from the link, at least one upward and forward pointing engaging corner being formed between the upper and front edges of each of the extended portions.

2. The crimp terminal of claim 1, wherein the at least one engaging corner on each of the extended portions comprises a plurality of the engaging corners on each of the extended portions in a stepped manner.

3. The crimp terminal of claim 1, further comprising a reinforcing ridge formed on the link.

4. The crimp terminal of claim 3, wherein the connecting portion and the crimp portion are spaced apart in a longitudinal direction, the reinforcing ridge extending in the longitudinal direction.

5. The crimp terminal of claim 4, wherein the reinforcing ridge is in a central section of the link in a width direction that is perpendicular to the longitudinal direction.

6. The crimp terminal of claim 1, wherein each of the engaging corners is rounded.

7. The crimp terminal of claim 1, further comprising a covering body covering at least parts of the crimp portion and the link and engaging the engaging corners.

8. The crimp terminal of claim 7, wherein the covering body is a heat shrinkable tube.

9. The crimp terminal of claim 1, wherein the extended portions align respectively with in the core crimping portions in a front to rear direction.

10. The crimp terminal of claim 1, wherein the connecting portion is substantially planar.

11. The crimp terminal of claim 10, wherein the connecting portion has a through hole passing through a central portion thereof.

12. The crimp terminal of claim 10, wherein at least a portion of the think is coplanar with the connecting portion.

* * * * *